US005562057A

United States Patent [19]

Lenson

[11] Patent Number: 5,562,057

[45] Date of Patent: Oct. 8, 1996

[54] DISH-SHAPED SEQUIN APPLICATION APPARATUS AND METHOD FOR SHUTTLE EMBROIDERY MACHINE

[76] Inventor: Harry Lenson, 1302 13th St., North Bergen, N.J. 07047

[21] Appl. No.: 881,462

[22] Filed: May 11, 1992

[51] Int. Cl.[6] ..... D05B 3/12

[52] U.S. Cl. ..... 112/88; 112/113; 112/128; 112/475.18

[58] Field of Search ..... 112/88, 99, 104, 112/108, 110, 113, 128, 129, 136, 152, 235, 408, 404, 439, 475.01, 475.18; 2/244, 279; 223/44, 48; 226/52, 55; 24/90 A, 90 E, 90 TA; 74/817; 156/93

[56] References Cited

U.S. PATENT DOCUMENTS

| | | | |
|---|---|---|---|
| 700,305 | 5/1902 | Cornely | 112/99 |
| 1,107,599 | 8/1914 | Fink | 112/99 |
| 2,400,616 | 5/1946 | Weiss | 223/48 |
| 2,436,759 | 2/1948 | Mueller | 223/48 |
| 2,493,735 | 1/1950 | Alifano et al. | 112/128 |
| 2,534,753 | 12/1950 | Bellow et al. | 112/113 X |
| 2,922,548 | 1/1960 | Anderson | 112/113 X |
| 3,390,650 | 7/1968 | Ochsner | 112/88 |
| 3,483,833 | 12/1969 | Conner, Jr. | 112/113 |
| 3,708,804 | 1/1973 | Santos | 2/244 |
| 4,436,041 | 3/1984 | Taddicken | 112/113 X |
| 4,623,411 | 11/1986 | Pollack et al. | 112/265.1 X |
| 4,765,265 | 8/1988 | Brownbill et al. | 112/88 |
| 4,807,546 | 2/1989 | Lenson et al. | 112/113 X |
| 4,848,253 | 7/1989 | Tajima | 112/99 |
| 5,054,407 | 10/1991 | Rowley | 112/136 X |

*Primary Examiner*—Ismael Izaguirre
*Attorney, Agent, or Firm*—Jones, Day, Reavis & Pogue

[57] ABSTRACT

A shuttle embroidery machine having an attachment, corresponding to each needle, for the selective application of dish-shaped sequins onto a cloth wherein the continuous strip of dish-shaped sequins is indexed by a rotary feed wheel through a feed member having a channel for guiding the dish-shaped sequins for severance. Each dish-shaped sequin sequentially exits the channel by a cutting blade actuated at appropriate times in coordination with the needle that sews each dish-shaped sequin to the cloth.

8 Claims, 4 Drawing Sheets

13
48
85
24
26
72
75
76
31
32
30
28
74
40
35
42
96
70
56
S
60
50
62
64
63
92
94
86
88
52
54
61
66
68
58
90
78
71

DISH-SHAPED SEQUIN APPLICATION APPARATUS AND METHOD FOR SHUTTLE EMBROIDERY MACHINE

BACKGROUND OF THE INVENTION

1. Field of the Invention

The present invention relates in general to an apparatus and method for selectively applying a sequin-like decoration to material during an embroidery operation and specifically relates to apparatus and a method for applying dish-shaped sequins to material during an embroidery operation.

2. Background Information

Details of the well-known shuttle embroidery machine are disclosed in U.S. Pat. No. 4,807,546, which is commonly assigned and which is incorporated herein by reference in its entirety.

Also disclosed in U.S. Pat. No. 4,807,546 is an attachment corresponding to each needle of the embroidery machine that attaches sequins to garments during the embroidery operation. Sequins are circular shiny discs that increase the appeal and attractiveness of the garment. The device of the patent includes an attachment to the machine corresponding to each needle which allows the flat dish-shaped sequins to be attached to the material without flaking and deforming the sequins.

In commonly assigned co-pending patent application Ser. No. 07/881,466 filed May 11, 1992 and entitled "Application and Method for Forming a Ribbon of Continuously Connected Dish-Shaped Sequins" (now U.S. Pat. No. 5,346,664), there is disclosed an apparatus and method for forming continuously connected dish-shaped sequins in a strip. This novel strip of continuously connected dish-shaped sequins enables a new use for the well-known shuttle embroidery machine in the form of a process for attaching dish-shaped sequins to a fabric. As disclosed in the co-pending patent application, a guide device receives a corresponding one of the spaced strips of dish-shaped sequins at its input. The guide device sequentially exposes each individual dish-shaped sequin at the output where it is cut from the strip of sequins and automatically attached to the fabric.

The present invention discloses a novel improved sequin guide attachment for use with the method in the commonly assigned co-pending application to not only sequentially feed the dish-shaped sequins through the guide and enable them to be individually severed from the strip at the output of the guide but also to provide an improved apparatus for severing each individual dish-shaped sequin from the strip. The present invention utilizes a rotary coin feed wheel for indexing a strip of dish-shaped sequins through a feed member such that each dish-shaped sequin is sequentially cut from the strip. The feed shaft is inserted through the axis of the rotating coin feed wheel for incrementally and rotatably positioning the wheel such that each dish-shaped sequin exits the feed member sequentially. A longitudinal bar mounted on the embroidery machine moveably receives the feed wheel such that the feed wheel and attachment are longitudinally adjustable with respect to the machine so that the guide attachments may be positioned with respect to the needles. A cutting device is pivotally attached to the lower end of the feed member such that as each dish-shaped sequin sequentially exits from the feed member it may be severed by the cutting device during movement of the needle bar to form an embroidery stitch and attach the severed sequin to the fabric.

The feed member includes a frame with a vertical chute such that the strip of dish-shaped sequins is positioned by the chute to enable each dish-shaped sequin to be severed at the bottom of the chute as the dish-shaped sequin exists from the chute. A restraining device is positioned in the chute for flexibly guiding the strip of dish-shaped sequins on the rotary coin feed wheel into and down the chute. The restraining device may have one of several configurations such as a flat strip of spring steel as described herein. The dish-shaped body is carried between the rotary wheel and the spaced flat strip of spring steel down the chute. A plate is flexibly secured to the frame by projections on one side of the plate and has a body portion positioned in the chute over the restraining device with sufficient space to allow the dish-shaped sequins to move down the chute between the flexible plate and the restraining guide. An elongated cutting blade is pivotally attached to the lower end of the feed member and forms the cutting surface such that the movement of the needle bar carrying the needle toward the fabric to sew a sequin on the fabric moves a projection that forces the pivotable elongated blade from its normal stationary position into cutting engagement with the sequin that has exited the chute. The projection is slidably attached to the needle bar and a piston is coupled to the projection to move it into alignment with the knife blade when a sequin is to be severed.

A sloping surface is formed on a corner of the pivotally elongated blade such that the sloping surface of the elongated blade engages the sequin as the knife rotates to sever the dish-shaped sequin without applying a twisting force to it. A spring is coupled to the pivotable elongated blade to return the elongated blade to its normal stationary position after severing the sequin. A stop block is attached to the feed member for preventing the elongated blade from going beyond its normal stationary position while being returned by the spring.

Thus, it is an object of the present invention to provide an improved feed member for dish-shaped sequins such that each dish-shaped sequin may be incrementally moved through the feed member and exit the feed member sequentially for removal thereof.

It is also an object of the present invention to provide a feed member with a frame having a vertical chute for carrying the dish-shaped sequins and a restraining device positioned in the chute for guiding the dish-shaped sequins, the restraining device comprising a resilient spring steel plate as set forth in U.S. Pat. No. 4,807,546.

It is still another object of the present invention to provide an elongated blade pivotally attached to the lower end of the feed member such that movement of the needle bar carrying the needle towards the fabric to sew a sequin on the fabric moves a projection into contact with the pivotable elongated blade to move it from its normal stationary position into cutting engagement with the dish-shaped sequin that has exited the chute.

It is still another object of the present invention to provide a dish-shaped sequin cutting blade that has a sloping surface thereon such that the elongated blade, when pivoted by the sewing needle, engages the dish-shaped sequin to sever the dish-shaped sequin without applying a twisting force to it.

SUMMARY OF THE INVENTION

Thus, the invention relates to an improved attachment for a shuttle embroidery machine for selectively applying dish-shaped sequin-like decorations to fabric comprising a rotary coin feed wheel for indexing a strip of dish-shaped sequins through a feed member such that each dish-shaped sequin is sequentially cut from the strip, a feed shaft inserted through the axis of the rotating coin feed wheel for incrementally and rotatably positioning the wheel such that each dish-shaped sequin exits the feed member sequentially, a longitudinal bar mounted on the machine for moveably receiving the feed wheel such that the feed wheel and attachment are longitudinally adjustable with respect to the machine, and a cutting surface pivotally attached to the lower end of the feed member such that as each dish-shaped sequin sequentially exits the feed member it may be severed by the cutting surface during movement of the needle bar carrying the needle to form an embroidery stitch and attach the sequin to the fabric.

The invention also relates to a process for automatically attaching dish-shaped sequins to a fabric with a needle on a shuttle embroidery machine comprising the steps of incrementally feeding a strip of continuously connected dish-shaped sequins to a feed member such that each dish-shaped sequin sequentially exits the feed member, pivotally attaching a cutting surface to the lower end of the feed member adjacent to the sequentially exiting dish-shaped sequins, and pivoting the cutting surface into the connection between the exited dish-shaped sequin and its adjacent sequin in coordination with movement of the needle such that each exited dish-shaped sequin may be sequentially attached to the fabric by the needle.

BRIEF DESCRIPTION OF THE DRAWINGS

These and other objects of the present invention will be more fully disclosed when taken in conjunction with the following detailed description of the drawings in which like numerals represent like elements and in which.

DESCRIPTION FOR THE PREFERRED EMBODIMENT

Figure 1:
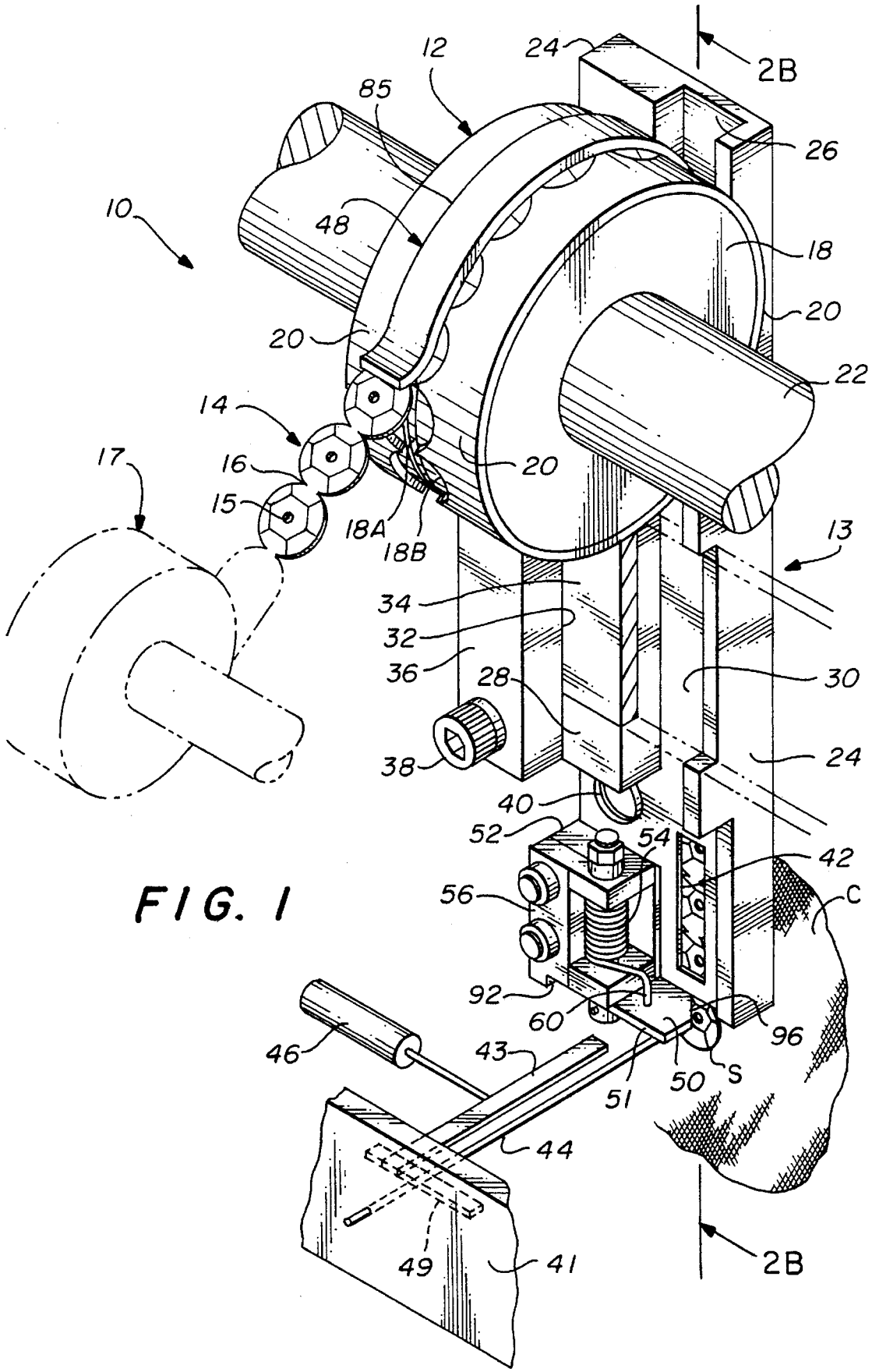
FIG. 1 illustrates a plurality of dish-shaped sequin attachments for a shuttle embroidery machine with rotary coin feed wheel, feed member and cylindrical sleeve.

An attachment 10 of the present invention is shown in FIG. 1. It comprises a rotary coin feed wheel 12 and feed member 13 and selectively severs and applies dish-shaped sequins S to fabric C incident to the embroidery thereof. An attachment 10 should be located corresponding to each needle 44 as illustrated in FIG. 1. Strip 14 of dish-shaped sequins, which is formed according to the apparatus and process of commonly assigned co-pending U.S. patent application Ser. No. 07/881,466, filed May 11, 1992 and entitled "Application and Method for Forming a Ribbon of Continuously Connected Dish-Shaped Sequins" and incorporated herein by reference in its entirety, is fed from feed wheel 17 into feed member 13 by means of the rotary wheel 12. Sequins S are severed from the strip at appropriate intervals to form a single circular dish-shaped sequin S to be applied to the material during embroidery. The dish-shaped sequin S has a substantially circular outer diameter with a slight degree of flattening at noon and at 6:00 o'clock due to the inherent process of severing the sequin S from the strip 14 without discarding any material. Hole 15 is centrally located in each dish-shaped sequin S and allows passage for both the needle 44 and the thread attached thereto.

Strip 14 of the dish-shaped sequins is specially processed, as disclosed in the co-pending patent application set forth above, to be used in attachment 10 of the present invention. At the neck portion 16, separating individual sequins S, a score line is formed on one or both sides perpendicular to the length of strip 14. Scoring of the connection between sequins S results in a cleaner separation of the sequin S from the strip 14, thereby substantially reducing damage to individual sequins. Careful scoring of the strip of sequins will ensure that the portion of strip 14 comprising the neck 16 is not unduly weak and will not sever during feeding of strip 14 from feed wheel 17 to rotary wheel 12. Severing of strip 14 at this point disrupts the embroidery process and requires immediate rethreading of strip 14 into rotary wheel 12 and eventual manual mending of the embroidery cloth C. The strip 14 may also be scored on the other side. The uniform undulating width of strip 14 must be sized properly to fit closely within coin feed band 20. The scored strip 14 of dish-shaped sequins is fed from the feed wheel 17 on a support stand with rod (not shown) and upon which rod the feed wheel 17 freely rotates. A corresponding feed wheel 17 is provided for each rotary wheel 12 along the length of the shuttle embroidery machine.

Figure 2:
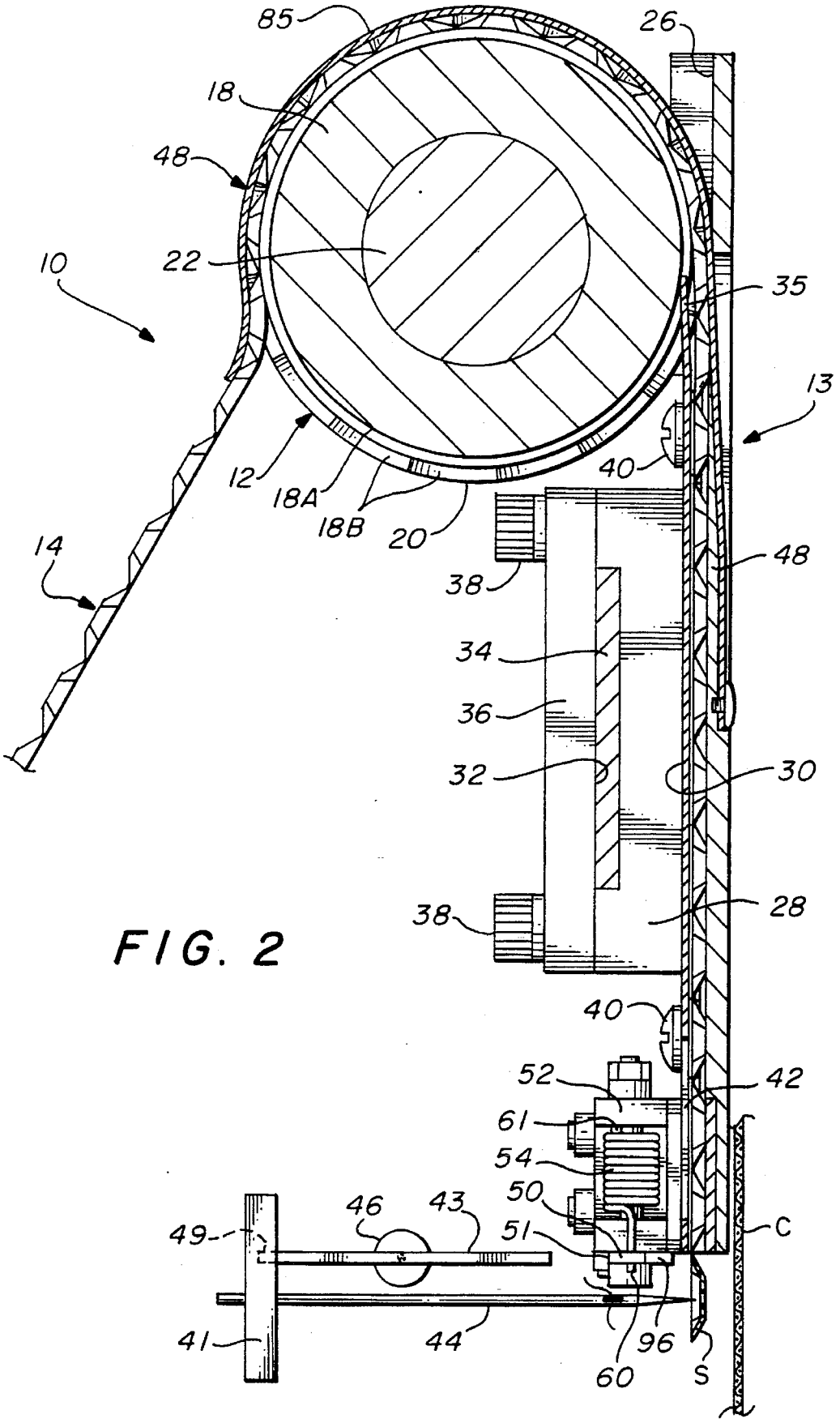
FIG. 2 is a cross sectional view of the sequin attachment in FIG. 1.

The scored strip 14 of dish-shaped sequins is fed from feed wheel 17 to rotary wheel 12. Rotary wheel 12, as more clearly shown in FIG. 2, comprises a core wheel 18 and coin feed band 20. Core wheel 18 is preferably formed of aluminum. Core wheel 18 is incrementally indexed via feed shaft 22, which shaft 22 is inserted through and frictionally mounted within the axes of the plurality of rotary wheels 12. The groove 18A, located centrally along the circumferential perimeter of core wheel 18, accepts the tab 35 on plate 30 which ensures that the strip 14 is properly fed into feed member 13. Groove 18A bisects the circumferential perimeter surface of core wheel 18 to form two radial surface edges 18B. Coin feed band 20 is laminated to core wheel 18 and is also bisected by groove 18A to form each half of coin feed band 20. Coin feed band 20 contains a series of intersecting circular apertures within which apertures the sequins S of strip 14 may be matingly fitted. The strip 14 of dish-shaped sequins is fed into rotary wheel 12 lying upon and supported by edges 18B and being suspended over groove 18A between the bisected coin feed band 20.

Each sequin portion of strip 14 is matingly fitted into a circular coin-shaped aperture of band 20. As rotary wheel 12 is advanced a distance equivalent to the length of a sequin S via feed shaft 22, the coin feed band 20 evenly distributes the force to strip 14. The band 20 comprises cold rolled steel or other material such that band 20 can be laminated onto core wheel 18 and can be precisely ground to snugly encompass the sequin strip 14 and will not be significantly worn over time.

Strip 14 is fed from rotary wheel 12 which is incrementally advanced or indexed via feed shaft 22 to feed member 13. Frame 24 of member 13 is aluminum or other material which may be easily and accurately ground. Frame 24 contains a vertical chute 26 through where the sequin strip 14 passes. Centrally located on frame 24 is platform 28 with duct 32 through which passes a mounting bar 34. The mounting bar 34 is supported by frame 24 on the shuttle embroidery machine. The longitudinal axis of both platform 28 and duct 32 is bisected by chute 26 and duct 32 supports mounting bar 34 above chute 26.

Frame 24 is mounted by engaging mounting bar 34 into duct 32 and then securing cover bar 36 to platform 28 with fasteners 37. Fasteners 38 are preferably manual screws with heads projecting above the surface of cover bar 36 so that the position of frame 24 along the length of the embroidery machine can be easily and quickly adjusted manually via mounting bar 34 or removed for repair.

A spring-like restraining device 48 is positioned in chute 26 and extends concentrically over rotary wheel 12. It not only applies pressure on the sequin strip 14 thereby maintaining the strip 14 inserted between each half of coin feed band 20 and lying on radial surface edges 18B and supported over groove 18A of rotary wheel 12, but it also guides the strip of sequins 14 into and down the chute 26. The restraining device 48 may be a solid spring steel strip as described in U.S. Pat. No. 4,807,546. The restraining device 48 may be formed of resilient spring steel such that it can be flexibly extended upward during threading of the strip 14 of sequins into rotary wheel 12 and when released, the restraining device 48 will again apply pressure on the strip 14. Restraining device 48 passes through slot 45 to the underside of chute 26 and is preferably fastened by a screw or any other well-known means 47 so that any damaged restraining device 48 can be more readily replaced. The restraining device 48 comprises carbon spring steel. It should be thin enough to retain its memory, but thick enough to resist breakage. Therefore the dimensions of the restraining device should be 0.003 to 0.025 inch in thickness, and preferably between 0.007 to 0.009 inch thick.

The sequin strip 14 is retained in chute 26 by a plate 30 over the end of restraining device 48. Plate 30 has a tab 35 extending upwardly and towards strip 14 in the rotary wheel 12. The width of tab 35 is less than or equal to the width of groove 18A and is placed into groove 18A under the sequin strip 14 for the purpose of assisting in guiding the sequin strip 14 into chute 26. Thus, the strip 14 passes into the chute 26 between tab 35 and restraining device 48. The plate 30 is fastened to frame 24 by means of screws or bolts 40 that are shimmed a sufficient amount to provide a clearance between plate 30 and the sequin strip 14. Plate 30 encloses the chute 26 along its length after the sequin strip 14 leaves the rotary wheel 12. As can best be seen in FIGS. 1, 3 and 4, plate 30 may have a window 42 at the bottom of chute 26 to enable the strip 14 of sequins to be seen. The advantages of the window 42 are more fully described in commonly assigned U.S. Pat. No. 4,807,546.

When the controlling mechanism signals that a sequin S should be applied to cloth C, then rotary wheel 12 is actuated via feed shaft 22 causing the strip 14 to be indexed through chute 26 such that a single sequin S protrudes from the bottom of feed member 13. The strip 14 is indexed by an increment corresponding to the diameter of the successive sequins S such that neck 16 is brought into alignment with the cutting edge of elongated blade 50. A sequin S is not exposed from chute 26 until required; therefore, during embroidery operation with no decorative application of sequins, projection 43 extending from needle bar 41 performs no function. When a sequin is to be attached to the material, projection 43 is positioned in a groove 49 by a piston 46 activated by the control signals until projection 43 is in alignment with cutting blade 50.

Projection 43 is of sufficient width to engage the top portion 51 of elongated cutting blade 50. The projection 43 is positioned in groove 49 parallel to the length of the needle 44 such that its outer end will engage upper surface 51 of elongated knife 50 to sever a single sequin S only when activated by piston 46. Otherwise it is out of alignment with knife 50. When wheel 12 is indexed to expose a sequin S, the needle 44 passes through the hole 15 in sequin S and then through cloth C. Sequin S remains attached to strip 14 until sequin S is contacted by knife blade 50. Blade 50 cleanly severs sequin S at scored neck portion 16 as the projection 43 contacts elongated blade 50 as the needle moves inwardly through the sequin S. A spring 54 is mounted in a spring block 52 and is attached to elongated blade 50 with spring projection 60 such that when projection 43 disengages knife blade 50, the spring 54 returns knife blade 50 to its original stationary position. A stop block 56 has a projection 92 thereon that catches the end of the knife blade 50 and prohibits it from moving beyond its normal stationary position. Blade 50 has a sloping surface 92 thereon such that the sloping surface 92 engages the sequin in a cutting action to sever the dish-shaped sequin while attempting to minimize any twisting force applied to it.

Figures 3, 4, 5:
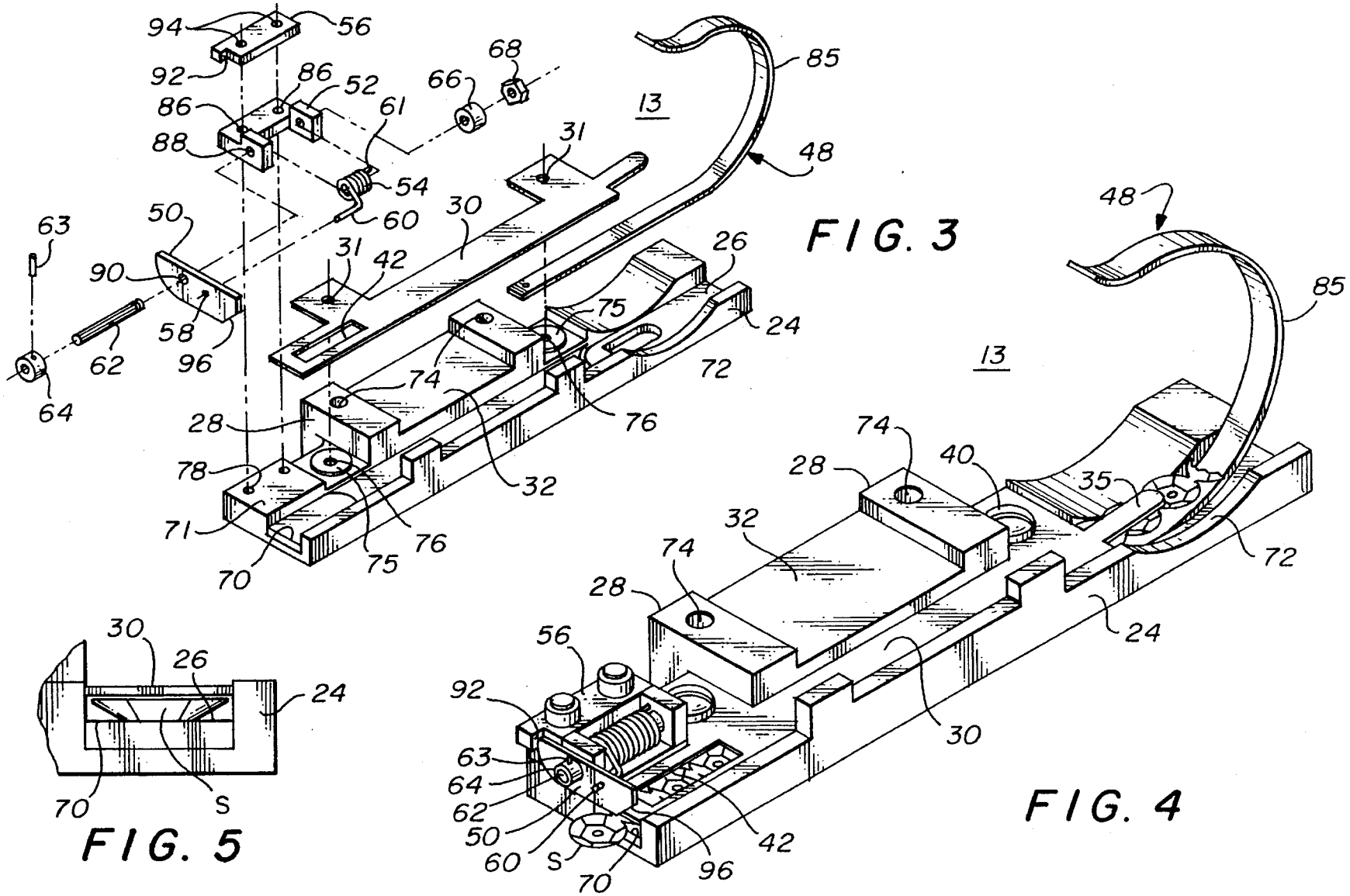
FIG. 3 is an exploded view of the novel attachment for feeding sequins sequentially to a needle on the shuttle embroidering machine.
FIG. 4 is an isometric view of the dish-shaped sequin feed mechanism.
FIG. 5 is a partial end view of FIG. 3 illustrating the chute with the restraining device and flexible plate with the dish-shaped sequin being shown therebetween.

FIG. 3 is an exploded view of the novel feed member attachment 13. The frame 24 can be seen with chute 26, An arcuate recessed area 72 is formed in the upper portion of the frame to accept the rotating core wheel 18. The sequins S exit at the lower portion 70 of chute 26. Platform 28 is illustrated with a duct 32 therein. Orifices 74 are provided for attaching the cover bar 25 illustrated in FIGS. 1 and 2A. Orifices 76 having shim 75 in alignment therewith are provided for attaching the retaining plate 30 and providing a space between plate 30 and the sequin strip 14. Base portion 71 has orifices 78 therein for attachment of the spring block 52 and the knife stop block 56. The restraining guide 48 for flexibly guiding the strip 14 of dish-shaped sequins on the rotating coin feed wheel 18 is also shown. The upper curved end 85 is flexible and in abutting engagement with the circumference of the core wheel 18 so as to guide the strip 14 of sequins into the chute 26.

The retaining plate 30 is shown having the orifices 31 to which it can be attached to the frame 24 over shim 75 to cause a space between plate 30 and sequin 14. It also has the tab 35 for guiding the sequins 14 from the core wheel 18 into the chute 26. It also illustrates the window 42 through which the sequins can be viewed in the lower portion of chute 26.

Spring 54 is inserted in spring block 52 such that shaft 62 can pass through orifice 90 of blade 50 and through the spring 54 and orifices 88 in spring block 52. A spacer 66 and nut 68 can be used to hold the shaft 62 securely in place. A collar 64 is placed on the other end of shaft 62 having an orifice therein through which a set screw or pin 63 can be placed to secure collar 64 to shaft 62.

Figures 6, 7, 8, 9:
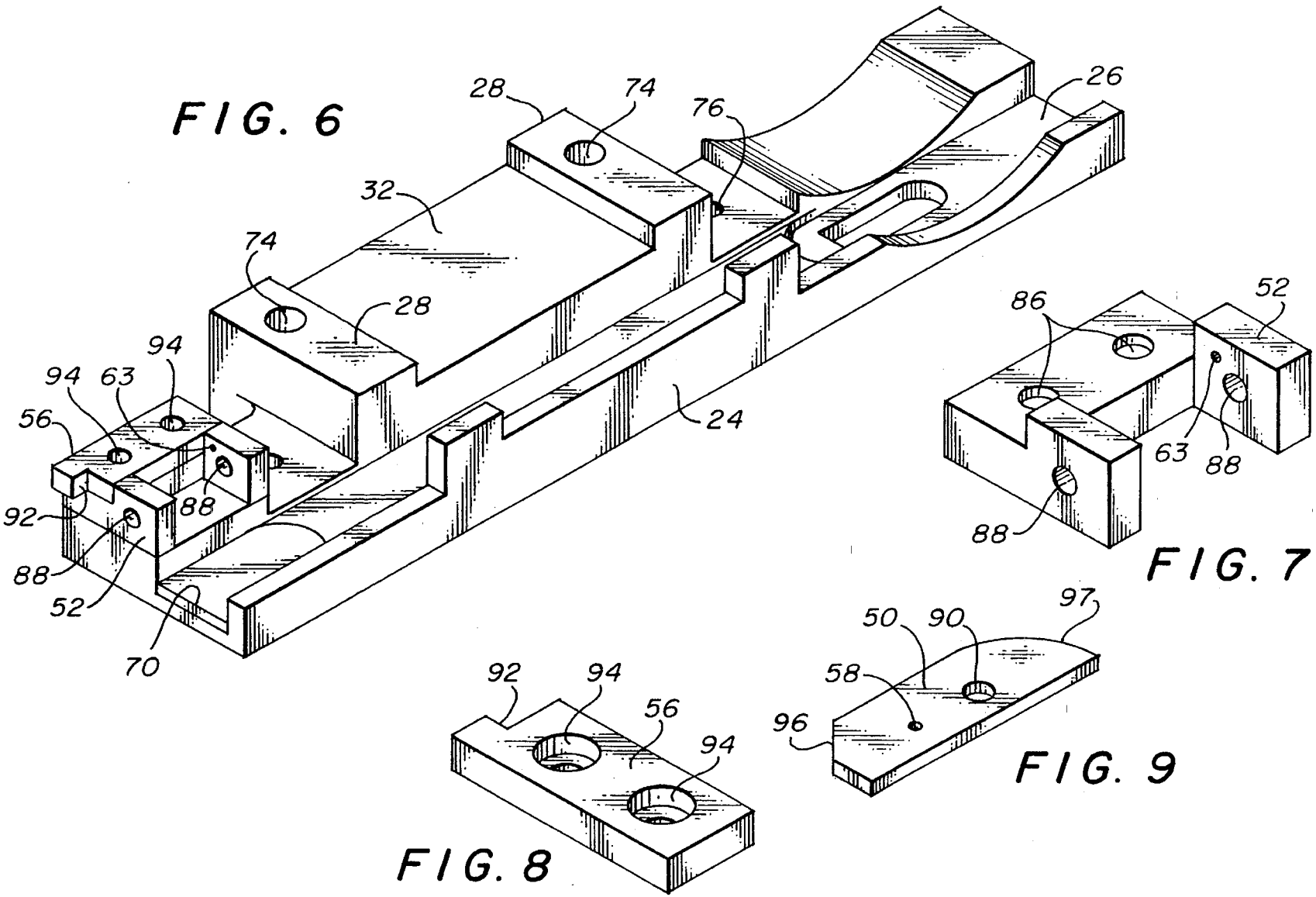
FIG. 6 is an isometric view of the feed mechanism illustrating only the chute and the guide member, the spring holding block and the knife stop block.
FIG. 7 is an enlarged view of the spring block.
FIG. 8 is an enlarged view of the knife stop block.
FIG. 9 is an isometric view of the sequin cutting knife.

Spring 54 has projections 60 and 61 for securing the spring to the cutting knife 50 and the spring block 52, respectively as will be shown more clearly in relation to FIGS. 4 and 7. The knife stop block 56 has orifices 94 therein that are in alignment with orifices 86 in spring block 52 and orifices 78 in base 71 of frame 24 for securely mounting both blocks 52 and 56 to the frame 24 in any well-known manner such as by bolts. A projection 92 on one end of the knife stop block 56 engages the knife 58, as will be discussed more fully herein, to prevent the knife from being returned by spring 54 beyond its normal stationary position. It will be noted in FIG. 3 that one end 97 of the knife 50 is curved. This curved end 97 allows the knife to rotate clockwise when viewed from the left in FIG. 3 but will engage the projection 94 on knife stop block 56 to prevent further counterclockwise rotation of the knife 50 as it is urged by spring 54 to return to its normal position. The projection 60 on spring 54 extends through orifice 58 in knife 50 and the projection 61 on the other end of spring 54 extends through an orifice 63 in the spring block, as will be shown hereafter.

FIG. 4 is an isometric view of the guide mechanism 13 illustrating the restraining device 48 in the upper portion thereof in relation to tab 35 of cover plate 30. Further, spring 54 can be shown mounted in spring block 52 and having end 60 thereof protruding through knife blade 50. When the projection 43 on needle bar 41 engages knife 50, knife 50 rotates clockwise from the left end of the view in FIG. 4 thus causing sloped edge 96 to engage the score line 16 between adjacent sequins and sever the sequin through which the needle 44 has passed. Spring 54 then returns knife 50 to its normal stationary position. The curved edge 97 of knife 50 contacts projection 92 on knife stop block 56, thus preventing any further counterclockwise rotation of knife blade 50 under the force of spring 54.

FIG. 5 is a cross-sectional view of the upper end of chute 26 and frame 24 illustrating the cover plate 30 and the sequin S. Thus, because of shim 75 sufficient space is left between plate 30 and the base of the chute 26 to allow free movement of the strip 14 of sequins S.

FIG. 6 is an isometric view of frame 24 of the feed member 13 illustrating the attachment of spring block 52 and knife stop block 56. Screws or bolts or any other well-known fasteners are inserted in orifices 94 to attach the knife stop block 56 and the spring block 52 to the frame 24. The projection 92 on knife stop block 56 can be clearly seen. This is the projection that engages the arcuate end portion 97 of knife 50 to prevent counterclockwise rotation beyond the normal stationary position of the blade when under the force of spring 54.

FIG. 7 is an isometric view of the spring block 52. The orifices 88 used to mount the spring 54 are clearly illustrated. Further the orifice 63 for the projection 61 on one end of spring 54 is also shown. The orifices 86 are in an axial alignment with the orifices 94 in the knife stop block 56 for attachment of the block 56 and the spring block 52 to the frame 24.

FIG. 8 is an isometric view of the knife stop block 56. The orifices 94 for mounting the block to the spring block 52 are illustrated and the projection 92 for preventing further counterclockwise rotation of the knife blade 50 under influence of spring 54 is also shown.

FIG. 9 is an isometric view of the knife blade 50. It has an orifice 90 with which it is rotatably attached to spring block 52 through orifices 88 thereof. It also has an orifice 58 for receiving the end 60 of spring 54. The sloping surface 96 on the pivotable elongated blade 50 is formed such that the sloping surface 96 engages the sequin to sever the sequin and tends to minimize any twisting force applied to it. The arcuate end portion 97 engages the projection 92 on knife stop block 56 to prevent further counterclockwise rotation of the knife 50 under the influence of spring 54 as described earlier.

Thus, there has been disclosed a novel feed mechanism for allowing dish-shaped sequins to be attached automatically to a fabric. In the prior art, such dish-shaped sequins had to be attached one-at-a-time by hand which, of course, is very expensive and does not have the quality of the machine stitching. The novel device includes a frame having a chute for receiving the strip of continuously connected dish-shaped sequins. An indexing wheel moves the sequins through the chute sequentially such that a single sequin emerges from the bottom of the chute each time a sequin is to be applied. A pivotable knife blade is located at the lower end of the feed member and forms a cutting surface such that the movement of the needle toward the fabric to sew a sequin on the fabric moves the pivotable elongated blade from its normal stationary position into cutting engagement with the sequin that has exited the chute. Rotation of the blade severs the single sequin from the strip. A projection is slidably attached to the needle bar and is aligned with the knife blade by a piston when a sequin is to be severed. Each time the needle moves forward and is inserted in the orifice in a sequin, the projection on the needle bar is aligned with and actuates the cutting blade to sever the sequin. The blade has a sloping surface thereon that is designed to cleanly sever the sequin from the continuous strip of sequins without damaging the sequin. A spring is coupled to the pivotable elongated blade to return the blade to its normal stationary position after severing the sequin. A stop block is attached to the feed member for preventing the elongated blade from going beyond its normal stationary position while being returned by the spring.

In the process for automatically attaching dish-shaped sequins to a fabric with a needle and a shuttle embroidery machine, the steps comprise incrementally feeding a strip of continuously connected dish-shaped sequins to a feed member such that each such dish-shaped sequin sequentially exits the feed member, pivotally attaching a cutting surface to the lower end of the feed member adjacent to the sequentially exiting dish-shaped sequin and pivoting the cutting surface into the connection between the exited dish-shaped sequin and its adjacent sequin in coordination with movement of the needle such that each exited dish-shaped sequin may be sequentially severed and attach the severed sequin to the fabric by the needle.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A shuttle embroidery machine with a plurality of needles and corresponding sequin guide attachments for automatically and selectively applying dish-shaped sequin-like decorations to fabric, the machine including a dish-shaped sequin guide attachment that comprises:

a frame with a vertical chute having an exit;

a rotary coin feed wheel for indexing a strip of continuously connected dish-shaped sequins through the vertical chute to enable each dish-shaped sequin to be sequentially severed from the strip as the dish-shaped sequin exits from the chute;

a sequin guiding device positioned in the chute and extending partially along the length of the chute for guiding the strip of dish-shaped sequins from the rotating coin feed wheel into and down the chute;

a plate secured on one side to the frame and positioned in the vertical chute over the guiding device such that the sequins move down the chute under the plate;

a feed shaft inserted through the axis of the rotating coin feed wheel for incrementally and rotatably positioning the wheel such that each dish-shaped sequin exits the vertical chute sequentially;

an elongated bar mounted on the machine for slidably receiving the feed wheel such that the feed wheel and the frame with the vertical chute are slidably adjustable along the bar with respect to the machine;

an elongated blade pivotally attached to the vertical chute and forming a cutting surface;

a projection slidably attached to the needle bar for each needle; and a piston coupled to the projection for slidably aligning the projection with the pivotable elongated blade such that the projection forces the blade into the dish-shaped sequin to sever the sequin from the strip of dish-shaped sequins.

2. The machine of claim 1 wherein the elongated blade includes a sloping surface such that the sloping surface of the elongated blade engages the sequin as the blade is pivoted to sever the dish-shaped sequin so as not to damage the sequin.

3. The machine of claim 2 further including a spring coupled to the pivotable elongated blade for returning the elongated blade to the normal stationary position after severing the sequin.

4. The machine of claim 3 further including a stop block attached to the feed member for preventing the elongated blade from pivoting beyond said normal stationary position while being returned by the spring.

5. A process for automatically attaching dish-shaped sequins to a fabric with a needle on the needle bar of a shuttle embroidery machine comprising the steps of:

incrementally feeding a strip of continuously connected dish-shaped sequins to a feed member, and thereafter exiting each dish-shaped sequin sequentially from the feed member;

guiding the dish-shaped sequins on a rotating feed wheel with a flexible guiding device extending partially lengthwise of a chute forming a portion of the feed member such that the sequins move into and travel through the chute and exit the chute sequentially;

coordinating movement of the needle towards the fabric to sew a sequin on the fabric with movement of a pivotable elongated blade as a cutting means; and pushing the pivotable elongated blade from a normal stationary position into cutting engagement with the dish-shaped sequin in a plane perpendicular to the plane of the sequin to sever the sequin by means of a needle bar projection selectively aligned with and engaging the pivotable elongated blade.

6. The process as in claim 5 further including the step of engaging the sequin with a sloping surface on the pivotable elongated blade such that the sloping surface severs the dish-shaped sequin without damaging said sequin.

7. The process as in claim 6 further including the step of forcing the pivotable elongated blade to return to its normal stationary position after severing the sequin.

8. The process as in claim 7 further including the step of preventing the elongated blade from pivoting beyond the normal stationary position while being forced to return after severing the sequin.

* * * * *